United States Patent [19]

Holmberg

[11] Patent Number: 4,662,041

[45] Date of Patent: May 5, 1987

[54] BELT LOCK

[75] Inventor: Göte E. Holmberg, Anderstorp, Sweden

[73] Assignee: Geypa GmbH & Co. KG, Pansdorp, Fed. Rep. of Germany

[21] Appl. No.: 777,691

[22] PCT Filed: Jan. 14, 1985

[86] PCT No.: PCT/SE85/00013

§ 371 Date: Sep. 5, 1985

§ 102(e) Date: Sep. 5, 1985

[87] PCT Pub. No.: WO85/02982

PCT Pub. Date: Jul. 18, 1985

[30] Foreign Application Priority Data

Jan. 14, 1985 [SE] Sweden ..... 8400163

[51] Int. Cl.[4] ..... A44B 11/26; A44B 21/00

[52] U.S. Cl. ..... 24/642; 24/639; 24/640; 24/652

[58] Field of Search ..... 24/642, 635, 636, 637, 24/639, 640, 641, 652, 656, 602, 603

[56] References Cited

U.S. PATENT DOCUMENTS

| | | | |
|---|---|---|---|
| 3,473,201 | 10/1969 | Hopka et al. | 24/639 |
| 3,570,078 | 3/1971 | Neumann et al. | 24/652 |
| 3,704,633 | 12/1972 | Iverson | 24/602 |
| 3,760,467 | 9/1973 | Lohr | 24/639 |
| 3,846,876 | 11/1974 | Weman | 24/641 |
| 3,935,618 | 2/1976 | Fohl | 24/642 |
| 4,100,657 | 7/1978 | Minolla | 24/642 |
| 4,392,282 | 7/1983 | Wier | 24/642 |
| 4,393,553 | 7/1983 | Wier | 24/640 |
| 4,468,843 | 9/1984 | Duclos et al. | 24/642 |

FOREIGN PATENT DOCUMENTS

| | | | |
|---|---|---|---|
| 89888 | 9/1983 | European Pat. Off. . | |
| 2925493 | 1/1981 | Fed. Rep. of Germany | 24/652 |
| 406420 | 12/1974 | Sweden . | |

*Primary Examiner*—Victor N. Sakran

*Attorney, Agent, or Firm*—Merchant, Gould, Smith, Edell, Welter & Schmidt

[57] ABSTRACT

A belt lock, particularly for the vehicle safety belts, comprising a lock housing (10) and a lock tongue (11). The lock housing forms a guide between two plates (12, 13) for receiving the lock tongue in the lock housing, and an ejector (23) is provided in the lock housing. The ejector can be displaced against spring bias by the insertion of the lock tongue into the guide. The lock housing is provided with a manually operable latch mechanism comprising a ball (21) which can be displaced in an aperture (22) in one plate and is spring-biased to engage a seat formed by an aperture (27) in the other plate (12) to be received in this position in an aperture (35) in the lock tongue with the center of the ball located in the aperture in the lock tongue while the lock tongue is retained against withdrawal from the lock housing. The latch mechanism also comprises a manually operable member (77) for displacing the ball against the spring bias. Then, the lock tongue is disengaged from the lock housing and the ejector is inserted, while ejecting the lock tongue, between the ball and the operating member to maintain the ball in the depressed position.

11 Claims, 13 Drawing Figures

BELT LOCK

The invention relates to a belt lock, particularly for vehicle safety belts, and the purpose of the invention is to provide a belt lock of the type comprising a lock housing and a lock tongue to be inserted into the lock housing, which comprises relatively few and simple components and provides great functional reliability. Accordingly, the lock breaks the tendency which has been dominating recently as far as the development of locks for vehicle safety belts is concerned and according to which the lock mechanism comprises a large number of complicated components arranged in such functional relationship that the risk of malfunction and rapid wear is greater than can be accepted.

According to the invention there is provided a lock of the type referred to above in accordance with claim 1.

Figure 1A:
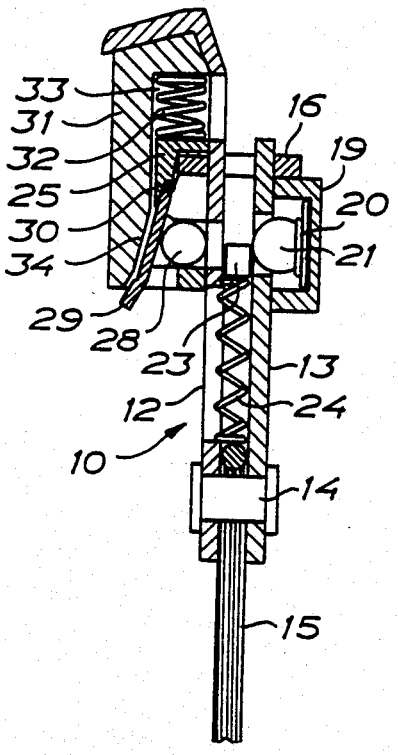
Figure 1B:
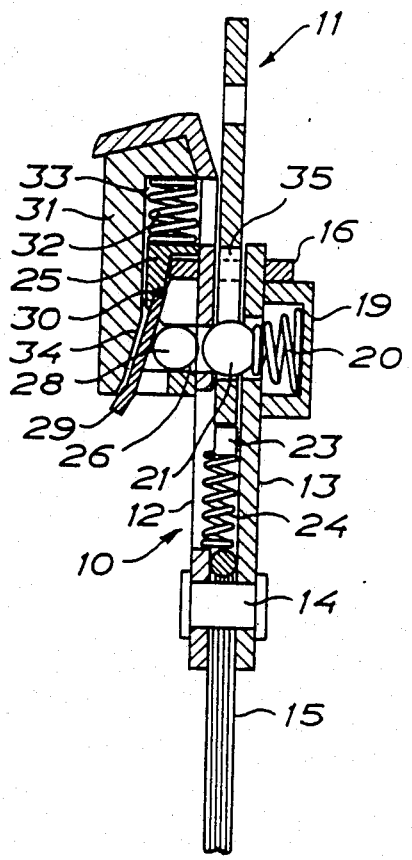
Figure 2:
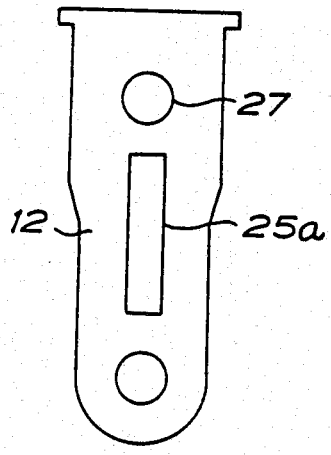
Figure 3:
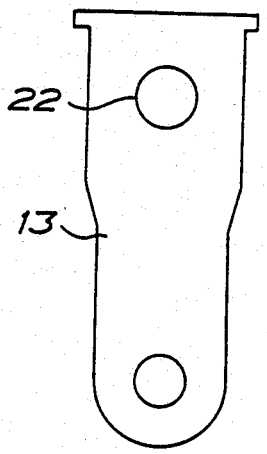
Figure 4:
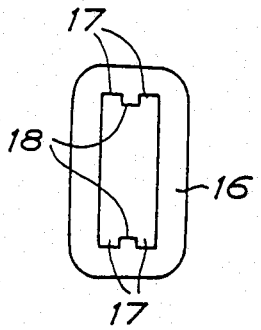

In order to explain the invention in more detail embodiments thereof will be described below, reference being made to the accompanying drawings in which FIGS. 1A and 1B are longitudinal sectional views of a lock of the invention in one embodiment thereof shown without lock tongue in FIG. 1A and with the lock tongue inserted into the lock housing in FIG. 1B, FIG. 2 is a plan view of a plate forming part of the lock housing, FIG. 3 is a plan view of another plate forming part of the lock housing and positioned in parallel to the plate of FIG. 2, FIG. 4 is a plan view of a guide frame for the plates of FIGS. 2 and 3, FIG. 5A and 5B are longitudinal sectional views similar to those of FIGS. 1A and 1B, respectively, showing a modified embodiment.

Figure 5B:
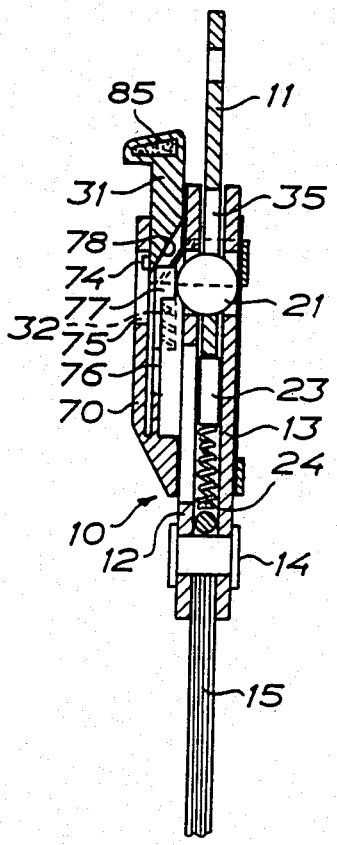
Figure 5A:
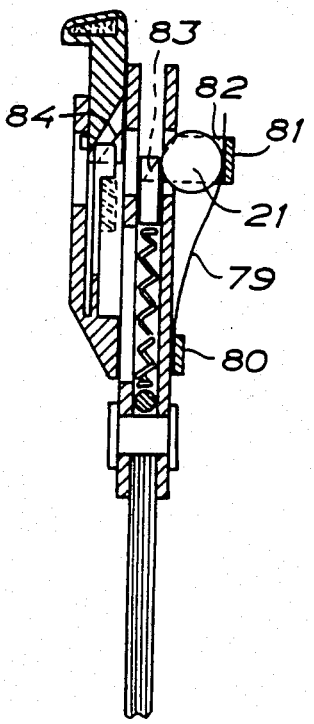
Figure 6:
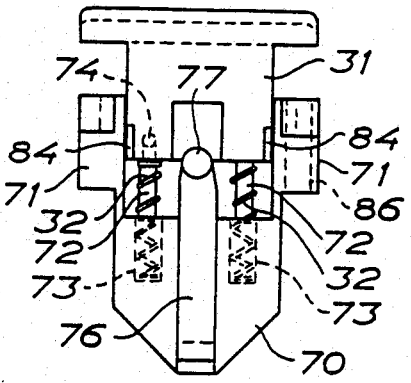
Figure 7:
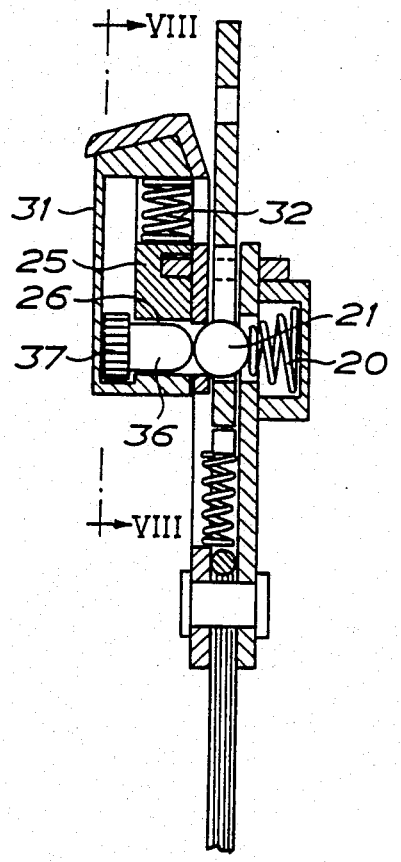
Figure 8:
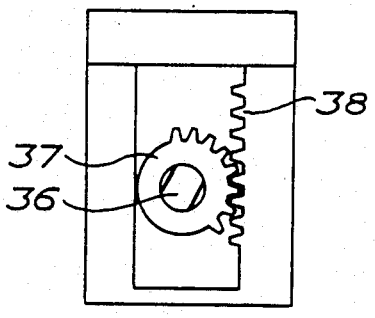
Figure 9:
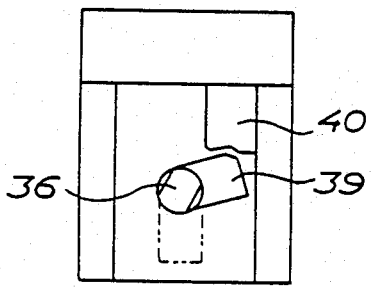
Figure 10:
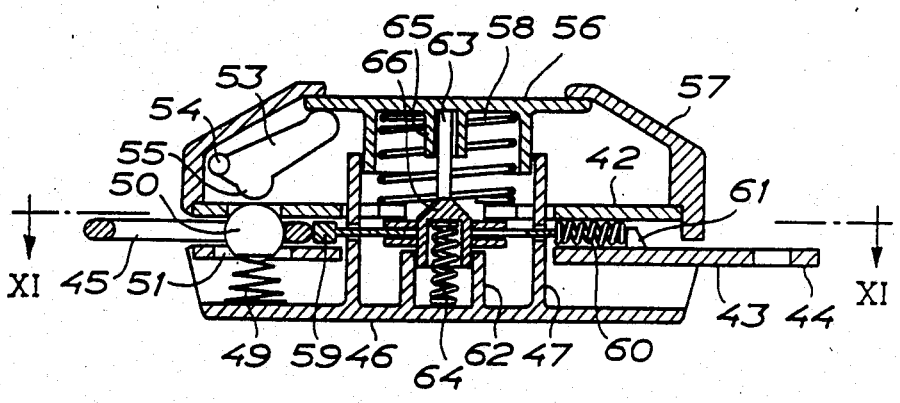
Figure 11:
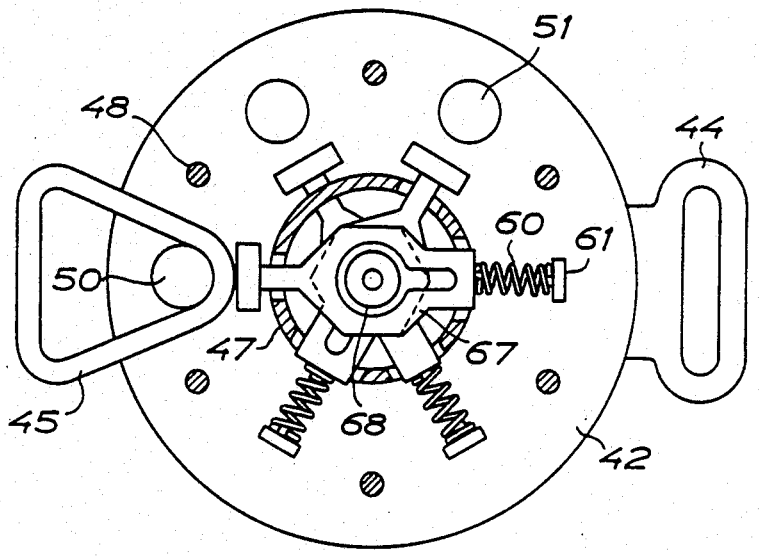

FIG. 6 is a plan view from below of the push button and the guide thereof in the embodiment of FIGS. 5A and 5B, FIG. 7 is a longitudinal sectional view similar to FIG. 1B of another embodiment of the lock of the invention, FIG. 8 is a view along line VIII—VIII in FIG. 7, FIG. 9 is a view similar to that of FIG. 8 of a modification, FIG. 10 is an axial sectional view of a lock for children's vehicle belts of the rucksack model, and FIG. 11 is a sectional view along line XI—XI in FIG. 10.

Referring to FIGS. 1 to 4, the lock shown therein comprises a lock housing 10 and a lock tongue 11 for mutual co-operation. The lock housing comprises two plates 12 and 13 which are mutually spaced a distance which is slightly larger than the thickness of the lock tongue. The plates 12 and 13 are interconnected at one end thereof by means of a through rivet 14, an anchoring and wire rope being disposed around said rivet, the portion encircling the rivet being located as a spacer between the plates. At the other end thereof the plates are inserted into a guide frame 16 which receives the plates in recesses 17 mutually spaced by projections 18 which form spacers between the plates. A housing 19 is mounted on the plate 13 and this housing can consist of plastic material and be connected to the plate 13 by snap action at studs. In the housing there is provided a compression spring in the form of a conical helical spring 20 which is engaged between the bottom of the housing 19 and a steel ball 21, the plate 13 having a circular aperture 22 of such diameter that the ball 21 can pass through the aperture. An ejector 23 is arranged between the plates 12 and 13 and is biased by means of a helical compression spring 24 partly received by a longitudinal slot **25*a* in the plate 12**.

An element **25*a* is mounted to the plate 12 as an attachment and guide member, and also this element can be made of plastic material and can be connected to the plate 12 in the same manner as the housing 19. The element 25 forms a circular aperture 26 which connects to an aperture 27 of the same size in the plate 12. Apertures 26 and 27 are in register with the aperture 22 in the plate 13 and the diameter thereof is smaller than that of the ball 21 and the aperture 27. In the passage formed by the apertures 26 and 27 a ball 28 is located. The passage is so large that the ball can pass through the aperture 26 as well as the aperture 27. A pressure arm 29 is pivoted to the element 25 at 30 and can be engaged with the ball 28. A push button 31 is provided for operating the pressure arm 29, and this push button is displaceably guided on the element 25 and is biased by a helical compression spring 32 received by a recess 33 in the push button and engaged between a boundary wall of the recess and the element 25. An inclined surface 34 of the push button co-operates with the pressure arm 29 so as to swing the pressure arm towards the ball 28 when the push button 31 is displaced downwards against the bias of the spring 32**.

The lock tongue 11 can be of substantially conventional construction and forms a longitudinal slot 35 which has a width which allows the ball 21 to pass through the slot.

When the lock tongue is not inserted into the lock housing, the functional components in the lock housing take the positions shown in FIG. 1A. i.e. the ejector 23 is pushed forwards under the bias of the spring 24 and is located between the two balls 21 and 28, the ball 21 being kept engaged with the ejector under the pressure of the spring 20.

Now that the lock tongue 11 is inserted into the lock housing in the space between the plates 10 and 13, it will displace the ejector 23 against the bias of the spring 24, the slot 35 of the lock tongue eventually being located in register with the ball 21 which then snaps into the slot 35 under the pressure of the spring 20 and will be pressed against the plate 12 with the ball 21 partly projecting into the aperture 27, because this aperture has a diameter which is smaller than the diameter of the ball 21. This condition is shown in FIG. 1B. In this connection, it should be noted that the relative dimensions of the aperture 27 and the ball 21 should be such that the ball 21 in the position of FIG. 1B has the centre thereof inside the slot 35 of the lock tongue, the centre preferably being located substantially at the centre of the distance between the plates 12 and 13. Accordingly, the lock tongue 11 is latched in the lock housing and cannot be withdrawn from the lock housing, because the ball 21 cannot be pressed from the slot 35 by pulling the lock tongue when it is located in the manner described with reference to FIG. 1B. Thus, the ball 21 forms a simple but effective latch member in the belt lock of the invention.

In order to disengage the lock tongue 11 from the lock housing 10 the push button 31 is depressed against the bias of the spring 32, the pressure arm 29 being pressed against the ball 28 due to engagement with the inclined surface 34, the ball 28 in turn being pressed against the ball 21 to push back said latter ball against the bias of the spring 20 from the position in the slot 35 of the lock tongue into the aperture 22 of the plate 13.

Eventually, the ejector 23 will eject the lock tongue 11 under the bias of the spring 24 when the lock tongue has been disengaged or substantially disengaged from the ball 21, and the ejector will take a position between the two balls, i.e. it will return to the position of FIG. 1A.

In relation to prior art locks wherein the latch member of the latch mechanism comprises a relatively complicated component which is stamped, bent and hardened, the use of a steel ball as the latch member provides a considerable simplification and, moreover, the advantage is achieved that the disengagement force will be small, particularly if the steel ball has great hardness and the friction against the ball therefore is low. Moreover, the ball 21 guides the lock tongue laterally, which is also an advantage in comparison with prior art locks wherein there may be an unbalanced load with annoying friction between the lock housing and the lock tongue as a result thereof, which in turn means an increased force for opening the lock. The ball 21 not only replaces more complicated latch members of a punched and bent construction, it also eliminates the risk of fracture surfaces existing in such prior art latch members, and thus the lock will provide a more reliable function.

The lock of the invention includes a smaller number of components and can easily be mounted in automatic working operations, and it can also easily be finished. All components are plane.

The embodiment of the lock disclosed herein in the practical embodiment thereof can be provided with a cover of plastic material or the like of an aesthetic design.

It should be mentioned that a switch of a signal circuit for indicating if the lock tongue is inserted into the lock housing or not, can be provided in the housing 19, the actuating member of the switch being disposed in the space between the plates 12 and 13 to be actuated by the ejector 23. In case the lock is mounted close to a light source —in some cars there is an illuminated ash tray adjacent the belt lock for the front seats—an optic fiber (light conductor) can be extended to the lock and have the end thereof adjacent the opening between the plates 12 and 13, the end of the fiber possibly being provided with a small lens, such that the light spot at the end of the optic fiber indicates the insert opening of the lock housing and thus facilitates the insertion of the lock tongue when it is dark in the car.

The embodiment described can be modified in several respects and one conceivable modification comprises exclusion of the ball 28 and replacement thereof by a pin-shaped projection on the pressure arm 29, said projection having a semi-spherical end for engagement with the ball 21.

A modification according to this principle is shown in FIGS. 5A, 5B, and 6. In the embodiment of these figures which is the embodiment of the invention preferred at present, a plastic element 70 having hook-shaped side portions 71 is slid onto the plate 12. This element forms a guide for the push button 31 which has pins 72 displaceably received by recesses 73 in the element 70, helical compression springs 32 being passed onto the pins to bias the push button. The movement of the push button is limited by a pin 74 being displaceably received by a slot 75 in the element 70.

The element 70 forms a tongue 76 integral with the element, which forms a pin 77 replacing the ball 28 in the embodiment previously described. Said pin projects towards the ball 21. The push button 31 forms an inclined surface 78 which can be engaged with the pin 77 to press the pin against the ball 21 when the push button 31 is depressed against the bias of the springs 32 such that the pin 77 is pressed against the ball 21.

The helical spring 20 in the embodiment previously described is in this case replaced by a leaf spring 79 of steel, which has a moulded plastic piece 80 thereon which is slid at hook-shaped end portions thereof onto the plate 13 for mounting the spring 79 on said plate. Another plastic piece 81 is also moulded on the leaf spring and forms two lugs 82 one at each side of the plate 13, said lugs forming inclined surfaces 83 facing the push button 31. The inclined surfaces are arranged for co-operation with inclined surfaces 84 on the push button.

When the lock tongue 11 is not inserted into the lock housing, the functional components in the lock housing take the positions shown in FIG. 5A in a manner corresponding to that described with reference to FIG. 1A. Under the pressure of the spring 79 the ball 21 is kept engaged with the ejector 23 and the push button 31 is kept in the projected end position thereof.

When the lock tongue 11 is inserted into the lock housing in the space between the plates 10 and 13, the ejector 23 will be pushed back against the bias of the spring 24 and the ball 21 will engage the lock tongue 11, the condition of FIG. 5B being attained in the manner previously described with reference to FIG. 1B.

In order to disengage the lock tongue 11 from the lock housing 10 the push button 31 is depressed against the bias of the springs 32, the inclined surface 78 of the push button sliding against the pin 77 which is pressed against the ball 21 to disengage said ball from the lock tongue 11 against the bias of the spring 79 as described in connection with the embodiment according to FIGS. 1A and 1B. However, in the present case, the push button 31 actuates at the inclined surfaces 84 thereof also the two lugs 82 at the inclined surfaces 83 thereof such that the leaf spring 79 is pressed towards the position shown in FIG. 5A not only via the pin 77 and the ball 21 but also directly via the lugs 82. This provides an important advantage of the embodiment of FIGS. 5A, 5B, and 6. In order that a lock shall operate satisfactorily in use all springs actuated at the insertion of the lock tongue into the lock housing must be small-gauge springs. Then, it is easier to insert the lock tongue and, moreover, the springs will last longer. A very severe problem is, however, connected with the use of small-gauge springs: the lock can be disengaged by impact or shock, which cannot, of course, be accepted, because this makes the lock unreliable. Just at a collision when the lock has to fulfil the vital function thereof, it can under such circumstances easily get out of engagement. In the lock described herein, the problem can be overcome by providing in the lock a heavy leaf spring 79 which at the greatest safety possible maintains the lock engaged even if it should be exposed to impact or shock. Nevertheless the lock tongue can be easily disengaged by depression of the push button 31, because the spring is actuated directly by the push button over the lugs 82. By this arrangement the passage of the ejector 23 over the spring-biased ball 21 is facilitated when the lock tongue is projected from the lock, and thus it is not necessary that the spring 24 is a heavy-gauge spring. This means that the resistance against the insertion of the lock tongue into the lock housing will not be particularly great; the lock tongue can be inserted easily and comfortably.

It is suitable that the inclined surfaces 84 have a somewhat steeper angle than the inclined surface 78 such that the leaf spring 79 will be depressed somewhat more rapidly than the ball 21.

The leaf spring 79 can be arranged to actuate a switch in a signal circuit for indicating if the vehicle belt is being used or not during driving.

Preferably, the push button 31 is made of a transparent plastic material and in that case there can be provided immediately under the press surface an insert 85 of a light-reflecting material which is illuminated by means of a LED which is mounted in a cavity 86 in one side portion 71 of the plastic element 70 and is directed towards the light-reflecting material in the push button. The insert 85 can be slid into the push button from one side thereof, and apertures may be provided in the push button for allowing light from the LED to reach the light-reflecting material. By this arrangement the push button is easy to find in darkness, because the press surface thereof is indicated by the reflecting material.

In FIG. 7 there is shown another modification wherein the ball 28 is replaced by a pin 36 which has an external flat thread of great pitch. The pin engages an internal thread in the aperture 26 in the element 25. At the upper end thereof the pin 36 is non-rotatably but axially displaceably guided in a gear 37 which according to FIG. 8 engages a rack 38 on the push button 31. When the push button is actuated against the pressure of the spring 32, the pin 36 thus will be rotated by the intermediary of the rack 38 and the gear 37 and the pin 36 will then be screwed axially through the aperture 26 to engage the ball 21 and depress the ball against the pressure. of the spring 20 in the same manner as in the embodiment of FIGS. 1 to 4. The pin 36 and the gear 37 can be made of plastic material, which makes the manufacture cheaper. The mounting of these components will be simple and, moreover, the disengagement force will be reduced, the lock at the same time obtaining somewhat smaller dimensions.

The embodiment of FIGS. 7 and 8 can be modified according to FIG. 9 wherein the gear 37 is replaced by an arm 39 which is non-rotatably but axially displaceably mounted to the pin 36 and co-operates with a cam 40 on the push button 31, the cam replacing the rack 38. By displacement of the push button 31 against the pressure of the spring 32 the arm 39 will be swung to the position indicated by dot-and-dash lines in FIG. 9, the pin 36 being screwed towards the ball 21 in the same way as in the embodiment of FIGS. 7 and 8.

In FIGS. 10 and 11 there is shown a lock for children's vehicle belts of the rucksack model. In such belts it is required nowadays that the four strap parts, viz. two shoulder strap parts and two hip strap parts, shall be interconnected in a central lock. Moreover, it is required that this central lock shall have a single operating member for disconnecting the four strap parts from each other. In FIGS. 10 and 11, the lock comprises a lock housing 41 which has a plate 42 and a plate 43 which are mutually spaced. The plate 43 forms an attachment 44 for connecting one of the hip strap parts while the two shoulder strap parts and the other hip strap part are provided with lock tongues 45. A bottom plate 46 which extends in parallel to the plates 42 and 43 spaced from the plate 43 forms a central socket 47 which can be arranged to maintain the plates 42 and 43 mutually spaced. Moreover, spacers or rivets 48 can be arranged for the same purpose. In the space between the plates 43 and 46 there is provided for each tongue a compression spring 49 and a ball 50 biased by the spring, the ball being dimensioned to be able to pass through an aperture 41 in the plate 43. An aperture 52 in the plate 42 registers with the aperture 51 and is smaller than the ball 50. The apertures 51 and 52 are circular. A pressure arm 53 is pivoted to the plate 42 at 54, and this pressure arm has a semi-spherical projection 55 to be engaged with the ball 50 at such projection. A push button 56 is displaceably mounted in the socket 47 for operation of the pressure arm 53, said push button being available in an opening in a cover 57 mounted to the plate 42. The push button is biased by means of a helical compression spring 58 and can be depressed against the bias of this compression spring for operating simultaneously the several balls arranged for all three lock tongues, said balls latching the lock tongues in the same way as described with reference to FIGS. 1 to 4 and can be operated by pressure against the push button 56 for disengagement of the lock tongues also in the same way as previously described.

For each ball 50 an ejector 59 is provided which is displaceably guided between the plates 42 and 43 and is biased by means of a compression spring 60. This compression spring is engaged between a stationary support 61 and the ejectors and actuates the associated lock tongue for ejecting said tongue when it has been disengaged from the lock housing. A pin 63 is displaceably guided by means of a socket 62 which is arranged on the bottom plate 46 adjacent the socket 47, said pin being biased by means of a helical compression spring 64 to engage the push button 56. This pin has a wider portion guided in the socket 62, and a narrower portion guided in a socket 65 on the push button 56, a conical portion 66 being provided between said two portions. Each ejector embraces the pin 63 at a central portion 67, a keyhole slot 68 being provided in said portion. When the push button is in the position shown and the ejector 59 is pushed back by means of the inserted lock tongue 45 against the pressure of the spring 60, the wider portion of the pin 63 is located in the wider portion of the central portion of the ejector 66. When the push button 56 is actuated against the pressure of the spring 58, the pin 63 will be depressed against the pressure of the spring 64 such that the narrower portion of the pin will enter the keyhole slot 67 in the ejector substantially at the moment when the lock tongue 45 is disengaged from the lock housing in the manner previously described. Under the pressure of the spring 60 the ejector 59 can project the lock tongue from the lock housing, the narrower portion of the pin 63 entering the narrower portion of the keyhole slot 68 to guidingly engage the ejector.

When the lock tongues shall again be engaged with the lock housing, the respective ejectors 59 are pushed back against the pressure of the springs 60 and not until all three ejectors have been pushed back, i.e. not until the three lock tongues are in the latched position. the pin 63 can be returned to the position shown under the pressure of the spring 64. Then, the ejectors are latched in the position shown until the push button 56 is again operated, the pin 63 at the same time abutting the push button 56 to indicate that all lock tongues are safely engaged in the lock.

I claim:

1. A belt lock for receiving a tongue comprising:

a lock housing having a first and second plate with opposite parallel flat surfaces mutually spaced to form a guide passage for receiving the tongue therein, said tongue and said plates each having an aperture therethrough, which apertures substantially register when the tongue in inserted in the guide passage;

a ball to be received by the apertures in the first plate and the tongue;

spring means biasing the ball towards the second plate forming a seat around the aperture therein to be engaged by the ball under the bias of the spring means, the ball being partly received in the aperture in the second plate with the center of the ball located in the aperture in the lock tongue when inserted in the guide passage to retain the tongue therein;

an outwardly biased ejector displaceable in the guide passage and limited in its forward movement in response to the bias to a position to block the apertures in said first and second plates, the ejector being displaced against the bias by the insertion of the tongue into the guide path; and a manually operable release member displaceable through the aperture in the second plate to engage tha ball to lift it from the seat against the spring bias for releasing the lock tongue from the lock housing, the ejector being insertable between the ball and the release number to keep the ball out of the guide passage against the spring bias after ejection of the released lock tongue.

2. Belt lock as claimed in claim 1, characterized in that the ball (21) is arranged to be received in the aperture (35) in the lock tongue (11) when engaging the seat, the centre of the ball being located substantially centrally between opposite flat sides of the lock tongue.

3. Belt lock as claimed in claim 1, characterized in that the aperture in the lock tongue (11) comprises a longitudinal slot (35).

4. Belt lock as claimed in claim 1, characterized in that the actuating member comprises a second ball (28) which can be engaged with the ball (21) through the seat.

5. Belt lock as claimed in claim 1, characterized in that the actuating member comprises a pin (36; 77) which can be engaged with the ball (21) through the seat.

6. Belt lock as claimed in claim 5, characterized in that the pin (77) is located on a resilient tongue (76).

7. Belt lock as claimed in claim 6, characterized in that the manually operable latch mechanism comprises a push button (31) which can be operated manually against spring bias substantially in parallel to the guide for the lock tongue (11) and that the push button is arranged to actuate, when displaced against spring bias, the pin (77) which can be engaged with the ball (21), over an inclined surface (78).

8. Belt lock as claimed in claim 7, characterized in that the ball (21) is biased by a leaf spring (79) and that the push button (31) is arranged to actuate, when displaced against the spring bias, the leaf spring to remove it from the ball (21) over at least one inclined surface (84) simultaneously with the actuation of the ball by means of the pin.

9. Belt lock as claimed in claim 8, characterized in that the inclined surface (84) for the actuation of the spring (79) is steeper than the inclined surface (78) for the actuation of the pin (77).

10. Belt lock as claimed in c1aim 7, characterized in that inwardly of the press surface of the push button (31) there is provided a light-reflecting material (85) and that a light source is provided to illuminate the light-reflecting material.

11. Belt lock as claimed in claim 1, characterized in that the ejector (23) is displaceably guided between the plates (12, 13).

* * * * *

UNITED STATES PATENT AND TRADEMARK OFFICE

CERTIFICATE OF CORRECTION

PATENT NO. : 4,662,041

DATED : 5 May 1987

INVENTOR(S) : Gote E. Holmberg

It is certified that error appears in the above-identified patent and that said Letters Patent is hereby corrected as shown below:

In column 4, line 52, "fulfil" should be --fulfill--.

In column 7, line 3, after "tongue", "in" should be --is--.

In column 7, line 26, "number" should be --member--.

In column 8, line 30, "claim" should be --claim--.

Signed and Sealed this

Twenty-ninth Day of September, 1987

*Attest:*

DONALD J. QUIGG

*Attesting Officer* *Commissioner of Patents and Trademarks*